US005971518A

United States Patent [19]

Bolash et al.

[11] Patent Number: 5,971,518

[45] Date of Patent: Oct. 26, 1999

[54] METHOD OF PRINTING WITH AN INK JET PRINTER TO INHIBIT THE FORMATION OF A PRINT ARTIFACT

[75] Inventors: John Philip Bolash; Stephen Kelly Cunnagin; Thomas Jon Eade; Scott Michael Heydinger; Timothy John Rademacher, all of Lexington, Ky.

[73] Assignee: Lexmark International, Inc., Lexington, Ky.

[21] Appl. No.: 08/789,928

[22] Filed: Jan. 28, 1997

[51] Int. Cl.[6] ..... B41J 29/38; B41J 2/21

[52] U.S. Cl. ..... 347/13; 347/43

[58] Field of Search ..... 347/9, 12, 15, 347/13, 14, 43; 395/115, 114, 101, 107, 108, 109; 358/296, 298

[56] References Cited

U.S. PATENT DOCUMENTS

| | | | |
|---|---|---|---|
| 4,829,468 | 5/1989 | Nonaka et al. | 395/117 |
| 4,864,328 | 9/1989 | Fischbeck | 347/43 |
| 4,896,275 | 1/1990 | Jackson | 395/115 |
| 4,901,248 | 2/1990 | Ueno et al. | 395/110 |
| 5,050,100 | 9/1991 | Damon et al. | 395/115 |
| 5,129,049 | 7/1992 | Cuzzo et al. | 395/113 |
| 5,150,454 | 9/1992 | Wood et al. | 395/114 |
| 5,191,430 | 3/1993 | Sudoh et al. | 358/296 |
| 5,208,676 | 5/1993 | Inui | 358/296 |
| 5,216,754 | 6/1993 | Sathi et al. | 395/113 |
| 5,295,233 | 3/1994 | Ota | 395/115 |
| 5,377,311 | 12/1994 | Carlock et al. | 395/115 |
| 5,382,968 | 1/1995 | Endoh | 347/112 |
| 5,398,053 | 3/1995 | Hirosawa et al. | 347/13 |
| 5,429,441 | 7/1995 | Schulz et al. | 400/124.04 |
| 5,432,891 | 7/1995 | Onodera | 395/114 |
| 5,471,322 | 11/1995 | Murata | 358/502 |
| 5,471,563 | 11/1995 | Dennis et al. | 395/114 |
| 5,479,587 | 12/1995 | Campbell et al. | 395/116 |
| 5,487,138 | 1/1996 | Rust et al. | 395/115 |
| 5,500,928 | 3/1996 | Cook et al. | 395/133 |
| 5,587,730 | 12/1996 | Karz | 347/43 |
| 5,598,192 | 1/1997 | Burger et al. | 347/43 |
| 5,726,691 | 3/1998 | Shioya et al. | 347/15 |
| 5,737,503 | 4/1998 | Mitani | 395/115 |

*Primary Examiner*—N. Le
*Assistant Examiner*—L. Anderson
*Attorney, Agent, or Firm*—John J. McArdle

[57] ABSTRACT

The invention is directed to a method of printing on a print medium using an ink jet printer. The ink jet printer includes a printhead assembly having a plurality of ink emitting nozzles. Ink is jetted onto the print medium from the printhead assembly during a first mode of operation using a first available set of the nozzles. Ink is jetted onto the print medium from the printhead assembly during a second mode of operation using a second available set of the nozzles, dependent upon a physical operating parameter of the ink jet printer. The second available set of nozzles has a smaller number of the nozzles than the first available set of nozzles.

8 Claims, 2 Drawing Sheets

METHOD OF PRINTING WITH AN INK JET PRINTER TO INHIBIT THE FORMATION OF A PRINT ARTIFACT

FIELD OF THE INVENTION

The present invention relates to ink jet printers, and, more particularly, to a method of printing with an ink jet printer using, a subset of the ink emitting nozzles in the printhead assembly.

DESCRIPTION OF THE RELATED ART

Ink jet printers typically include a carriage which is scanned across a print medium, such as paper, in a direction transverse to the feed direction of the paper. The carriage carries an ink jet cartridge assembly having an ink reservoir and a printhead assembly. For a typical tri-color ink jet cartridge assembly, the printhead assembly includes three sets of nozzles corresponding to three different color inks. A first set of nozzles is used for jetting cyan ink onto the paper, a second set of nozzles is used for jetting magenta ink onto the paper, and a third set of nozzles is used for jetting yellow ink onto the paper.

During printing, ink is typically jetted onto the paper from all of the available nozzles in the printhead assembly, including the cyan nozzles, magenta nozzles and/or yellow nozzles. More particularly, as the printhead assembly is scanned across the paper, ink is selectively jetted from any or all of the available nozzles in the printhead assembly.

It is known to employ a software algorithm which uses only a subset of the available nozzles in the printhead assembly during a particular scan across the paper. Such software algorithms are intended to prevent the formation of a print artifact on the paper. The software algorithms generally control the timing, sequence and/or placement of the ink dots on the paper, and do not relate to any electrical or mechanical hardware associated with the ink jet printer. Examples of such software algorithms include shingling and dithering.

During normal printing with an ink jet printer, the print data for a number of print lines or rasters is received from the host computer by the printer. The print buffer memory in the printer is typically sized to receive print data corresponding to a predetermined number of print lines. However, if the print data for a particular print line is a "complex line" having data corresponding to complicated graphics images therein, the print buffer memory size may be too small to receive all of the necessary data to scan the printhead assembly across the entire width of the paper. It is thus possible that a pause or delay may occur as the printhead assembly is scanned across the paper. Such a pause may result in the formation of an undesirable print artifact being formed on the paper. The print buffer memory size thus defines a printer hardware constraint or physical operating parameter of the ink jet printer which may affect the print quality of the image generated on the paper.

What is needed in the art is a method of recognizing a printer hardware constraint or physical operating parameter of an ink jet printer and controlling the printing process such that print quality is maintained at a desired level.

SUMMARY OF THE INVENTION

The present invention is directed to a method of printing using an ink jet printer, wherein all or only a subset of the nozzles in the printhead assembly are utilized during a scan of the ink jet cartridge assembly, dependent upon a physical operating parameter of the printer.

The invention comprises, in one form thereof, a method of printing on a print medium using an ink jet printer. The ink jet printer includes a printhead assembly having a plurality of ink emitting nozzles. Ink is jetted onto the print medium from the printhead assembly during a first mode of operation using a first set of available nozzles. Ink is jetted onto the print medium from the printhead assembly during a second mode of operation using a second set of available nozzles, dependent upon a physical operating parameter of the ink jet printer. The second set of available nozzles has a smaller number of the nozzles than the first set of available nozzles.

An advantage of the present invention is that a physical operating parameter of the printer is accommodated by using only a subset of the nozzles available for printing during a particular scan of the ink jet cartridge assembly.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
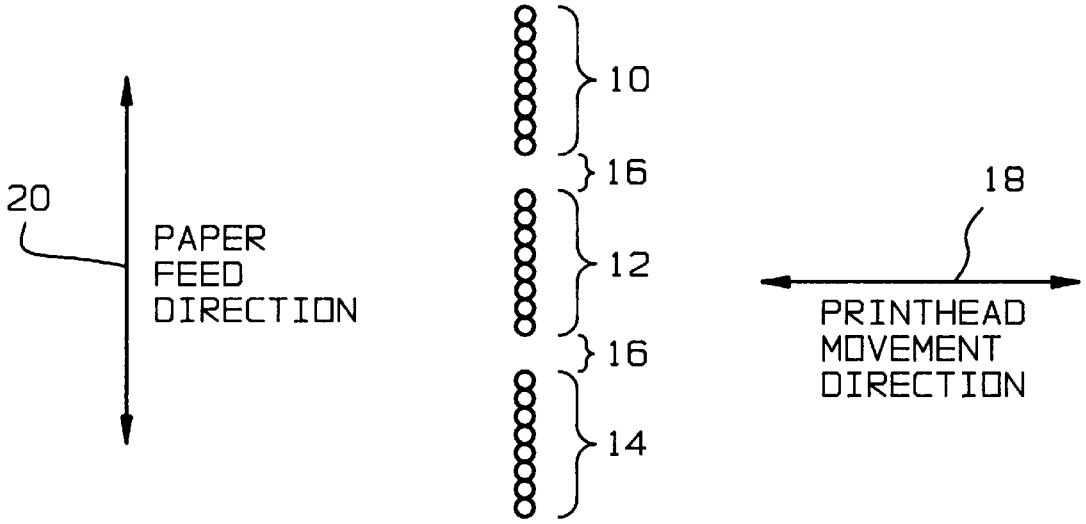
FIG. 1 is a schematic view illustrating the positioning of ink emitting nozzles in a tri-color printhead assembly for an ink jet printer.

Referring now to the drawings and more particularly to FIG. 1, there is shown a schematic view illustrating the positioning of ink emitting nozzles in a tri-color printhead assembly for an ink jet printer. The ink emitting nozzles include a group of cyan nozzles 10 from which cyan ink is jetted, a group of magenta nozzles 12 from which magenta ink is jetted, and a group of yellow nozzles 14 from which yellow ink is jetted. Cyan nozzles 10, magenta nozzles 12 and yellow nozzles 14 are typically arranged in a substantially linear relationship relative to each other, as shown. A gap 16 corresponding to a distance of approximately 2 nozzles separates cyan nozzles 10, magenta nozzles 12 and yellow nozzles 14. Each gap 16 exists because of manufacturing reasons.

Cyan nozzles 10, magenta nozzles 12 and yellow nozzles 14 form part of a printhead assembly in an ink jet printer. The printhead assembly in turn forms part of an ink jet cartridge assembly which is installed within the printer. The ink jet cartridge assembly is mounted on a carriage which traverses a print medium such as paper in a cross-machine direction. Thus, the printhead assembly carried by the carriage likewise moves across the print medium in a cross-machine direction, as indicated by double ended arrow 18 in FIG. 1. The print medium or paper is selectively moved in a feed direction 20 between scans of the printhead assembly. Cyan nozzles 10, magenta nozzles 12 and yellow nozzles 14 conjunctively define a first set of available nozzles from which the respectively colored inks may be jetted onto the print medium. In the embodiment shown in FIG. 1, the first set of available nozzles includes all of the nozzles defining the cyan nozzles 10, magenta nozzles 12 and yellow nozzles 14.

During use, the first print data corresponding to the first eight print lines or rasters of information are received by the ink jet printer. These eight rasters of information correspond to the first eight yellow rasters of information used for jetting ink from yellow nozzles 14. The paper is moved upward along feed direction 20 until the first eight rasters of information align with the eight yellow nozzles 14. The printhead assembly is scanned across the paper as indicated by arrow 18 and yellow ink is selectively jetted onto the paper from yellow nozzles 14. The paper is then moved vertically a distance equal to a height of eight rasters. The printhead assembly is then scanned across the paper as indicated by arrow 18. During this second scan of the printhead assembly, the next eight yellow rasters of information are used to jet ink from yellow nozzles 14, and the first six magenta rasters of information (because of the gap 16 having a height of two rasters) are used to jet ink from the first six magenta nozzles 12. The paper is again moved in a vertical direction a height corresponding to eight rasters of information and this process continues until the entire print image to be printed has been formed on the paper.

Figure 2:
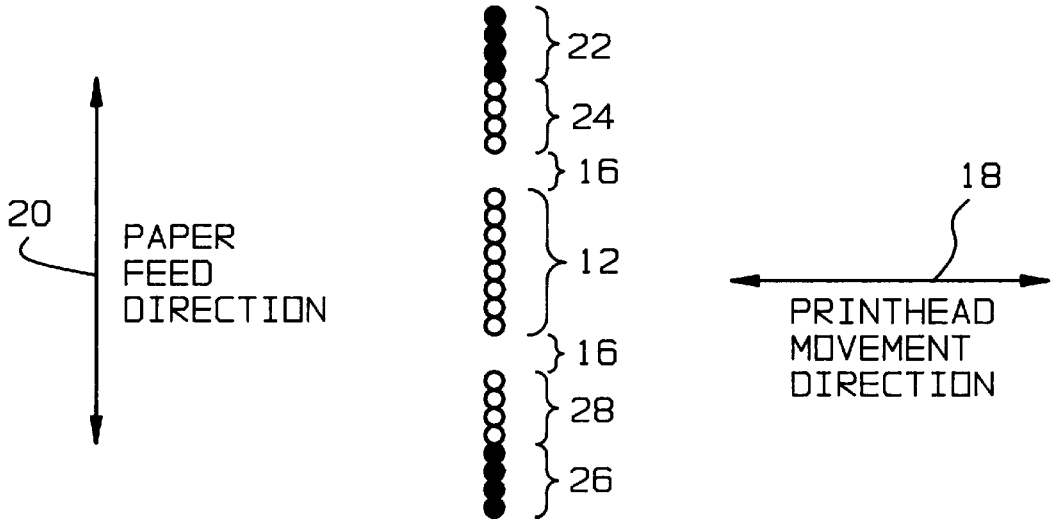
FIG. 2 is a schematic view illustrating the positioning of ink emitting nozzles in a tri-color printhead assembly similar to FIG. 1, but with a smaller number of available nozzles for printing dependent upon physical operating parameters associated with the printer.

Referring now to FIG. 2, there is shown a schematic view illustrating the positioning of ink emitting nozzles in a tri-color printhead assembly similar to the schematic view shown in FIG. 1. However, in the embodiment shown in FIG. 2, a smaller number of ink emitting nozzles are available for printing during a particular scan of the printhead assembly across the print medium. More particularly, the cyan nozzles are divided into a group of non-available nozzles 22 and a group of available nozzles 24. Likewise, the yellow nozzles are divided into a group of non-available nozzles 26 and a group of available nozzles 28. If a physical operating parameter or printer hardware constraint is present which does not allow an efficient use of all of the nozzles in the printhead assembly, then a portion of the nozzles in the printhead assembly are removed as available nozzles for printing, such as non-available cyan nozzles 22 and non-available yellow nozzles 26. Cyan nozzles 24, magenta nozzles 12 and yellow nozzles 28 define a second set of available nozzles which are fewer in number than the first set or entire set of nozzles 10, 12 and 14 shown in FIG. 1.

The present invention utilizes a subset of the entire set of available nozzles, dependent upon a physical operating parameter or printer hardware constraint associated with the ink jet printer. This is in contrast with a typical software algorithm which arbitrarily uses only a subset of the nozzles in order to achieve a certain print quality or avoid a certain print artifact. Examples of physical operating parameters of printer hardware constraints which may require use of the ink jet printer in a second mode of operation using a subset of the full set of nozzles may include, e.g., a size of a print buffer memory in the printer, an amount of electrical power which may be used by the printhead assembly, or a rate of flow of ink to the nozzles of the printhead assembly. Another example of a physical operating parameter which may require use of the printer in the second mode of operation using a subset of the fill set of nozzles is a data transfer rate of print data from the host computer to an electrical processor in the ink jet printer.

In the schematic view shown in FIG. 2, the printhead assembly includes eight cyan nozzles 22, 24, eight yellow nozzles 12, and eight magenta nozzles 26, 28. However, it is also to be understood that the number and/or positioning of the cyan, magenta and/or yellow nozzles making up the printhead assembly may vary. Moreover, the exact number of non-available nozzles and/or the exact positioning of the non-available nozzles within the entire array of cyan, magenta and yellow nozzles may vary depending upon the particular application.

During use, print data corresponding to the first four print lines or rasters of information are received by the ink jet printer. These four rasters of information correspond to the first four yellow rasters of information used for jetting ink from yellow nozzles 28. The paper is moved upward along feed direction 20 until the first four rasters of information align with the four yellow nozzles 28. The printhead assembly is scanned across the paper as indicated by arrow 18 and yellow ink is selectively jetted onto the paper from yellow nozzles 28. The paper is then moved vertically a distance equal to a height of four rasters. The printhead assembly is then scanned across the paper as indicated by arrow 18. During this second scan of the printhead assembly, the next four yellow rasters of information are used to jet ink from yellow nozzles 28, and the first two magenta rasters of information (because of the gap 16 having a height of two rasters) are used to jet ink from the first two magenta nozzles 12. The paper is again moved in a vertical direction a height corresponding to four rasters of information and this process continues until the entire print image to be printed has been formed on the paper.

Figure 3:
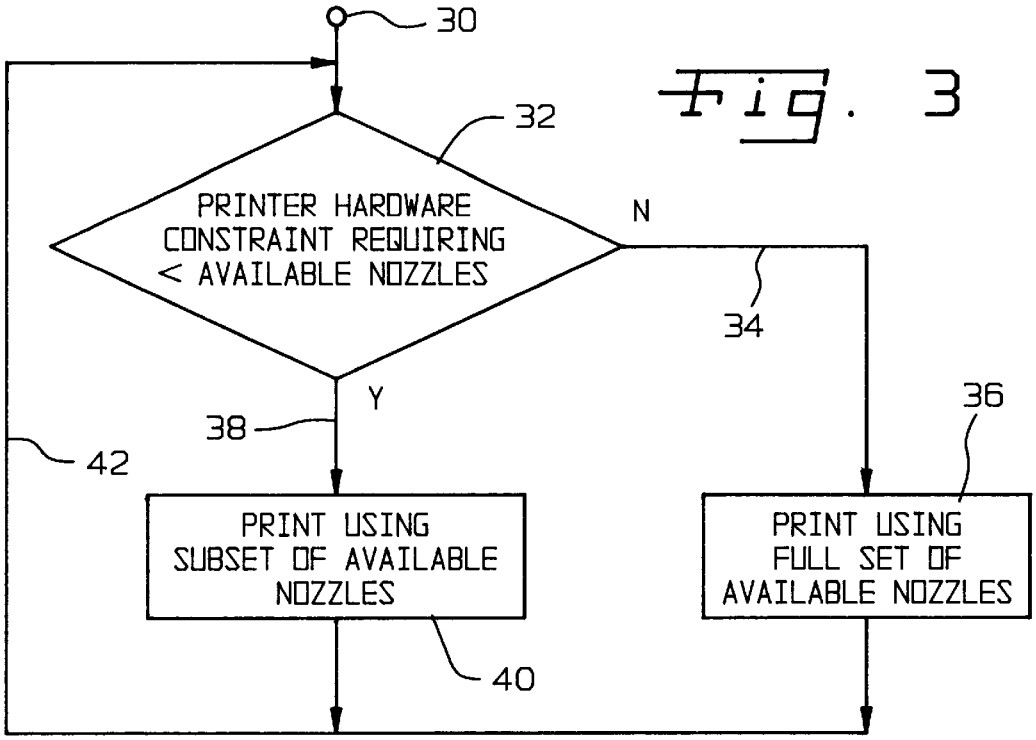
FIG. 3 is a flowchart illustrating an embodiment of a method of the present invention for printing on a print medium using an ink jet printer.

Referring now to FIG. 3, there is shown a flowchart illustrating an embodiment of a method of the present invention for printing on a print medium such as paper using an ink jet printer. The start location for the flowchart shown in FIG. 3 is represented by reference number 30. It is to be understood that the start location 30 may be implemented at any point during the printing process, such as during a scan of the printhead assembly or between scans of the printhead assembly. Moreover, the method illustrated by the flowchart shown in FIG. 3 may be carried out on a continuous or intermittent basis, depending upon the particular application and/or possible printer hardware constraints.

At decision block 32, a determination is made as to whether the ink jet printer includes a printer hardware constraint or physical operating parameter which will not or does not allow effective use of all of the available nozzles in the printhead assembly. If no such printer hardware constraint or physical operating parameter exists (line 34) then printing is carried out using the full set of available nozzles in the printhead assembly (block 36), such as nozzles 10, 12 and 14 shown in FIG. 1. Control then returns back to the input of decision block 32 via line 42.

On the other hand, if a printer hardware constraint or physical operating parameter does exist which does not allow effective use of all of the available nozzles in the printhead assembly (line 38), then printing is carried out using only a subset of the available nozzles in the printhead assembly (block 40) such as cyan nozzles 24, magenta nozzles 12 and yellow nozzles 28 shown in FIG. 2. Control then returns back to the input of decision block 32 via line 42.

In the flowchart shown in FIG. 3, the printer hardware constraint indicated in decision block 32 may be any of a number of printer hardware constraints or physical operating parameters which do not allow effective use of all of the available nozzles in the printhead assembly. For example, the printer hardware constraint shown in decision block 32 may be in the form of a size of a print buffer memory in the ink jet printer, an amount of electrical power which may be used by the printhead assembly, or a rate of flow of ink to the nozzles of the printhead assembly. Other printer hardware constraints or physical operating parameters which do not allow an effective use of all of the available nozzles in the printhead assembly are also possible. An example of such a further physical operating parameter may be a rate of data transfer from the host computer to the processor in the ink jet printer. For ease of illustration, however, these and other printer hardware constraints and physical operating parameters affecting the use of the available nozzles in the printhead assembly are simply and generally represented as a "printer hardware constraint" in decision block 32.

Figure 4:
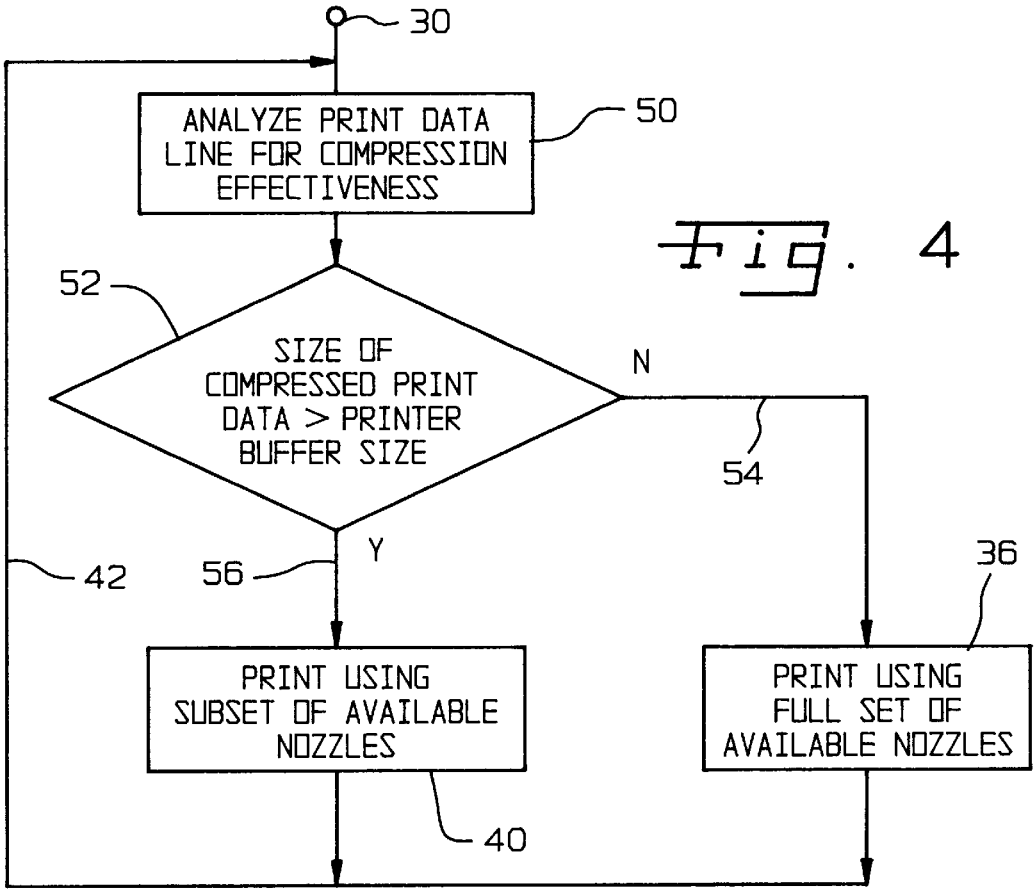
FIG. 4 is a flowchart illustrating another embodiment of a method of the present invention for printing on a print medium using an ink jet printer.

FIG. 4 is a flowchart illustrating another embodiment of a method of the present invention for printing on a print medium using an ink jet printer. More particularly, the flowchart shown in FIG. 4 corresponds to the case where the printer hardware constraint or physical operating parameter affecting the ability to utilize all of the available nozzles in the printhead assembly is a size of a print buffer memory in the ink jet printer.

At block 50, the print data corresponding to a print data line or raster is analyzed to determine whether an employed compression scheme is effective to compress the print data line small enough to fit into the print buffer memory. Of course, the compression ratio for the particular compression scheme utilized may differ from one print job to another, or may vary during a particular print job. Moreover, the step shown in block 50 may be eliminated if no compression scheme is utilized.

At decision block 52, a determination is made as to whether the compressed print data for a print data line or raster is greater than the print buffer memory size. If the compressed print data is not greater than the print buffer size (line 54; i.e., the compressed print data will fit within the print buffer), then printing is carried out using the full set of available nozzles, such as cyan nozzles 10, magenta nozzles 12 and yellow nozzles 14 shown in FIG. 1. Control then loops back to the input of block 50 via line 42.

On the other hand, if the size of the compressed print data is greater than the print buffer memory size (line 56; i.e., the compressed print data will not fit within the print buffer memory), then printing is carried out using only a subset of the available nozzles in the printhead assembly, such as cyan nozzles 24, magenta nozzles 12 and yellow nozzles 28 shown in FIG. 2. Control then loops back to the input of block 50 via line 42.

The method illustrated by the flowchart shown in FIG. 4 allows the use of a smaller print buffer memory in the ink jet printer. For example, when printing is carried out using the fall set of available nozzles 10, 12 and 14 shown in FIG. 1, the print buffer memory must be sized to store 8+2+8+2+8 cyan rasters, 8+2+8 magenta rasters and 8 yellow rasters, for a total of 54 rasters. For a 300 dot per inch (dpi), 8 inch wide line and 8 dots per byte, a total of 54 rasters * 300 dpi=16,200 bytes of required storage space within the print buffer memory, without compressing the data. On the other hand, when printing with a subset of the available nozzles, such as cyan nozzles 24, magenta nozzles 12 and yellow nozzles 28 shown in FIG. 2, the print buffer memory must be sized to store 4+2+8+2+4 cyan rasters, 4+2+8 magenta rasters, and 4 yellow rasters, for a total of 38 rasters. For a 300 dpi, 8 inch wide line and 8 dots per byte, a total of 38 rasters * 300 dpi=11,400 bytes of required storage space within the print buffer memory, for non-compressed data. It is thus possible to reduce the memory size of the print buffer memory utilizing the method of the present invention as described herein.

During use, a continual determination is made as to whether the compression effectiveness for a print data line is sufficient to allow the print data line to be stored in the print buffer memory. The print buffer memory may be sized such that the majority of the print data received from the host computer will effectively compress and fit within the print buffer memory. Accordingly, for the majority of the print data, the full set of available nozzles 10, 12 and 14 shown in FIG. 1 will be used during a particular scan of the printhead. On the other hand, for a complex line of print data which will not effectively compress and store within the print buffer memory, the subset of available nozzles 24, 12 and 28 shown in FIG. 2 may be utilized. This allows the print buffer memory to be sized for the majority of the print data received from the host computer, while at the same time preventing printer pauses and the like from occurring during printing of a complex line.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of printing on a print medium using an ink jet printer, the ink jet printer including a printhead assembly having a printhead with a plurality of ink emitting nozzles, said method comprising the steps of:

determining whether a physical operating parameter of the ink jet printer is present, said physical operating parameter being external to the printhead assembly, said physical operating parameter preventing use of at least one of the ink emitting nozzles;

jetting ink onto the print medium from said printhead assembly using a first set of available nozzles on said printhead when said physical operating parameter is not present; and jetting ink onto the print medium from said printhead assembly using a second set of available nozzles on said printhead when said physical operating parameter is present, said second set of available nozzles being a smaller number of the nozzles than said first set of available nozzles.

2. The method of claim 1, wherein said physical operating parameter comprises a size of a print buffer memory in the ink jet printer.

3. The method of claim 1, wherein said physical operating parameter comprises an amount of electrical power which may be used by said printhead assembly.

4. The method of claim 1, wherein said physical operating parameter comprises a rate of flow of ink to the nozzles of the printhead assembly.

5. The method of claim 1, wherein said first set of available nozzles comprises all of said nozzles.

6. The method of claim 1, wherein the printhead assembly comprises a tri-color printhead assembly having a plurality of each of cyan, magenta and yellow nozzles, said nozzles being aligned substantially perpendicular to a direction of movement of the printhead assembly, said magenta nozzles being disposed between said cyan and yellow nozzles, said second set of available nozzles comprising a portion of said cyan and yellow nozzles and all of said magenta nozzles.

7. The method of claim 1, wherein said first set of available nozzles comprises 24 nozzles, and said second set of available nozzles comprises 16 nozzles.

8. A method of printing on a print medium using an ink jet printer, the ink jet printer including a printhead assembly having a plurality of ink emitting nozzles, said method comprising the steps of:

determining a size of a print buffer memory in the ink let printer;

comparing a size of print data corresponding to a line of print with said size of said print buffer memory;

jetting ink onto the print medium from said printhead assembly using a first set of available nozzles if said size of the print data is one of less than and equal to said size of said print buffer memory; and jetting ink onto the print medium form said printhead assembly using a second set of available nozzles if said size of the print data is greater than said size of said print buffer memory, said second set of available nozzles being a smaller number of the nozzles than said first set of available nozzles.

* * * * *